US007677993B2

(12) United States Patent
McTavish

(10) Patent No.: US 7,677,993 B2
(45) Date of Patent: Mar. 16, 2010

(54) TENNIS BACKBOARD

(75) Inventor: Hugh McTavish, Birchwood, MN (US)

(73) Assignee: StrokeMaster Backboard, LLC, Birchwood, MN (US)

( * ) Notice: Subject to any disclaimer, the term of this patent is extended or adjusted under 35 U.S.C. 154(b) by 0 days.

(21) Appl. No.: 11/445,852

(22) Filed: Jun. 3, 2006

(65) Prior Publication Data

US 2006/0281589 A1 Dec. 14, 2006

Related U.S. Application Data

(60) Provisional application No. 60/688,582, filed on Jun. 8, 2005.

(51) Int. Cl.
*A63B 69/38* (2006.01)

(52) U.S. Cl. ..... 473/459; 473/434; 473/435

(58) Field of Classification Search ..... 473/459, 473/434, 435

See application file for complete search history.

(56) References Cited

U.S. PATENT DOCUMENTS 4,093,218 A * 6/1978 Burchers ..... 473/435
D265,413 S * 7/1982 Millikan ..... D21/799.1
4,373,720 A * 2/1983 Lombardi et al. ..... 473/434
4,421,318 A * 12/1983 Sverdlik et al. ..... 473/476
4,491,321 A * 1/1985 Veenema ..... 472/92
4,588,190 A * 5/1986 Stewart et al. ..... 473/435
4,693,472 A * 9/1987 Newman et al. ..... 473/435
5,833,234 A * 11/1998 Vavala et al. ..... 473/434
5,857,679 A * 1/1999 Ringe et al. ..... 273/395
2003/0236139 A1* 12/2003 Jensen et al. ..... 473/434
2005/0049088 A1* 3/2005 Chang et al. ..... 473/434

* cited by examiner

*Primary Examiner*—Raleigh W. Chiu
(74) *Attorney, Agent, or Firm*—Hugh McTavish

(57) ABSTRACT

The invention provides a new tennis backboard design. The backboard includes a firm backing layer underlying a soft deadening layer. The rebound of a tennis ball from the backboard is reduced as compared to rebound from a rigid hard-surface backboard. This allows a player to stand fairly close to the backboard, which reduces misses. The player can stand fairly close and hit balls hard against the backboard. Because the rebound is reduced, the ball simply bounces back softly and easily to the player, allowing the player to hit hard again from a fairly short distance. Thus, long rallies without missing are easily achieved. Since the bounce is reduced, the player can stand closer to the backboard, and therefore the backboard can be smaller than conventional backboards without the player missing the backboard. This allows the backboard to be light, portable, and easily stored. Because of the addition of a soft deadening layer, the firm backing layer of the backboard can also be thin and made of lighter and weaker material than a conventional backboard, reducing the weight of the backboard.

7 Claims, 7 Drawing Sheets

TENNIS BACKBOARD

This application claims priority from U.S. provisional patent application Ser. No. 60/688,582, "Tennis Backboard," filed Jun. 8, 2005, which is incorporated by reference.

BACKGROUND

A tennis backboard is a useful tool to enjoy some tennis when a player cannot find a partner. A backboard is also a good practice tool for a player to improve his or her skills. Hitting against a backboard can also be good exercise.

However, backboards are heavy and immobile. They are very large and therefore not suited for home use. It also requires a fairly high level of tennis skill to keep a rally against a backboard going for more than a few shots. This limits the usefulness of a backboard for a player to "groove" her shots. The track of a ball bouncing off a backboard also typically is lower than a ball in a rally, resulting in a lower bounce than a player gets in a real match, which impairs the usefulness of the backboard for practice.

New tennis training devices are needed. Preferably, a new training device would be suited for home use and easily moved. Preferably a new training device would facilitate long consecutive rallies by players and help players develop consistent strokes. Preferably, a new training device would be easier for beginning players to use.

SUMMARY

The invention provides a new tennis backboard design. The backboard includes a firm backing layer underlying a soft deadening layer. The rebound of a tennis ball from the backboard is reduced as compared to rebound from a rigid hard-surface backboard. This allows a player to stand fairly close to the backboard, which reduces misses. The player can stand fairly close and hit balls hard against the backboard. Because the rebound is reduced, the ball simply bounces back softly and easily to the player, allowing the player to hit hard again from a fairly short distance. Thus, long rallies without missing are easily achieved. The ball tends to come back to the same spot, allowing a player to hit the same shot with the same form over and over again. This makes for excellent practice where a player can really "groove" his or her strokes. Since long rallies are so easy, hitting against this backboard is also excellent exercise. Rallies tend to be limited only by the player getting tired, instead of by missing the board or the ball bouncing away.

Since the bounce is reduced, the player can stand closer to the backboard, and therefore the backboard can be smaller than conventional backboards without the player missing the backboard. This allows the backboard to be light, portable, and easily stored. Because of the addition of a soft deadening layer, the firm backing layer of the backboard can also be thin and made of lighter and weaker material than a conventional backboard, reducing the weight of the backboard.

Thus, the invention provides a tennis training apparatus that includes a backboard having (i) a firm backing layer underneath (ii) a soft deadening layer; wherein rebound of a tennis ball from the backboard is reduced as compared to rebound from a rigid hard-surface backboard.

Preferably the backboard is mounted on a plurality of legs in the apparatus. Preferably the apparatus is portable.

Another embodiment provides a tennis training apparatus including: (a) a backboard having (i) a firm backing layer underneath (ii) a soft deadening layer comprising closed-cell foam; wherein the backboard is adapted to be mounted permanently on supports; and wherein the apparatus is weatherproof and adapted to be stored permanently outdoors. For instance, the backboard can be mounted on fence posts of a fence surrounding a tennis court.

One embodiment of the invention provides a tennis training apparatus comprising: (a) a backboard comprising (i) a firm backing layer underneath (ii) a soft deadening layer; mounted on (b) a stand; wherein rebound of a tennis ball from the backboard is reduced as compared to rebound from a rigid hard-surface backboard, and wherein the apparatus is portable.

Another embodiment of the invention provides a tennis training apparatus comprising: (a) a backboard comprising (i) a firm backing layer underneath (ii) a soft deadening layer of resilient polymer foam at least 2 inches thick and having a density of less than 2.5 lbs/ft$^3$ and a compression number of less than 45; mounted on (b) a stand; wherein the backboard is generally planar and is held on the stand at a backward lean of 5°-30° relative to a perpendicular to the ground, rebound of a tennis ball from the backboard is reduced as compared to rebound from a rigid hard-surface backboard, and the apparatus is portable.

DETAILED DESCRIPTION

Definitions:

The term "portable" as used herein means able to be moved by one adult of average strength without tools, either by carrying, dragging, or rolling. An apparatus is considered portable herein if it weighs less than 120 pounds, or if it weighs less than 200 pounds and has wheels or low-friction gliders that can be used to roll or slide the apparatus.

Figure 1:
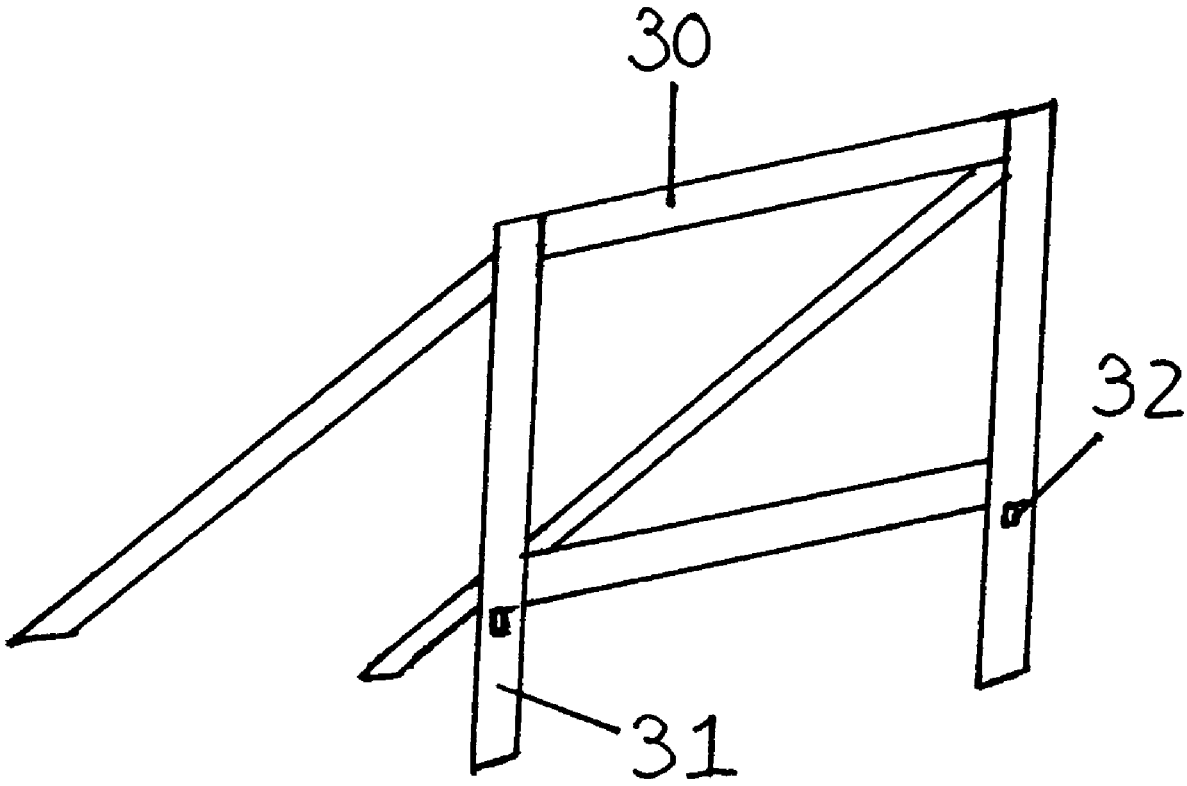
FIG. 1 shows a stand for supporting a backboard of the invention.
Figure 2:
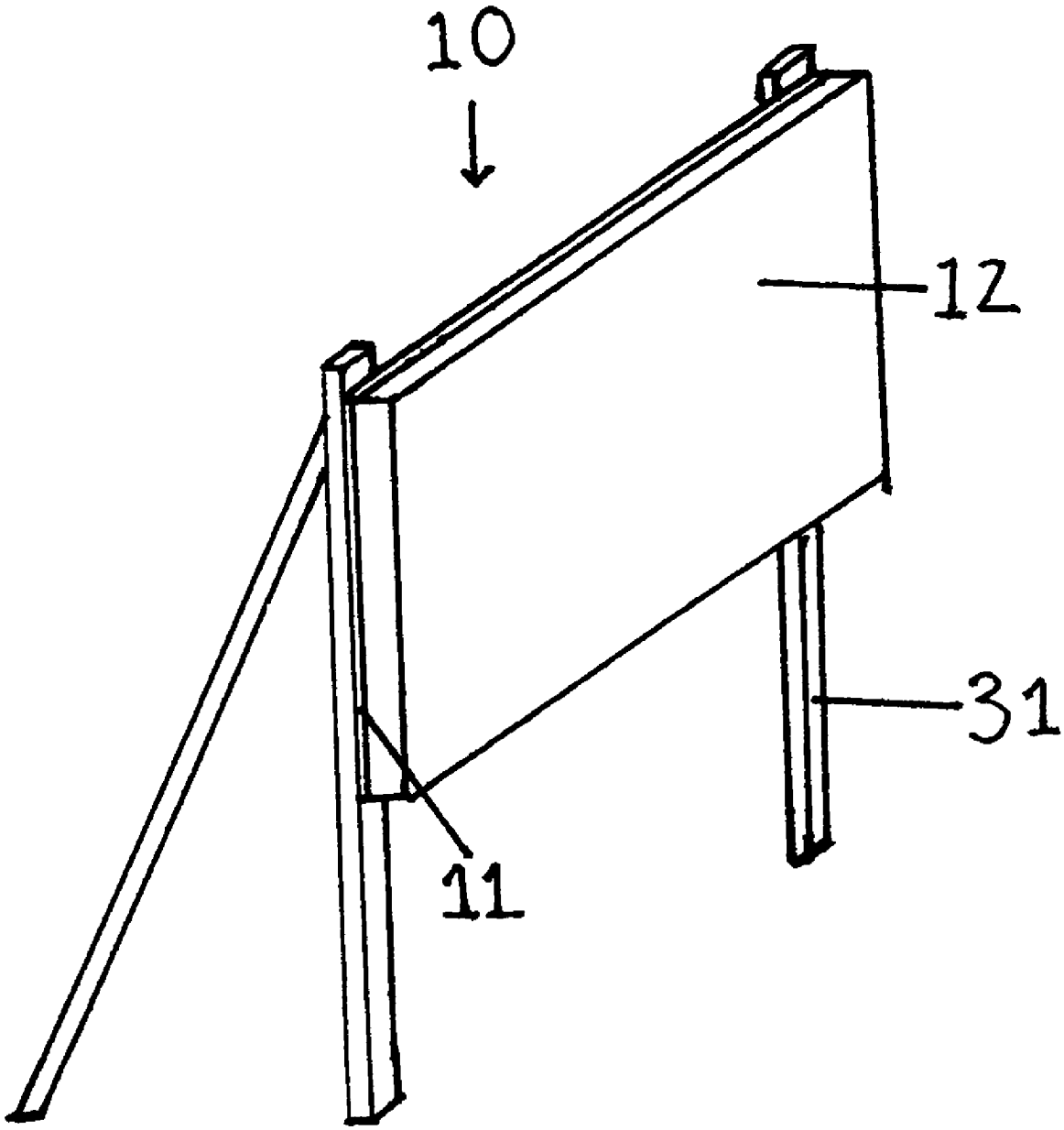
FIG. 2 shows an apparatus of the invention including a stand with legs for supporting a backboard of the invention.

Description:

The invention provides a tennis backboard and an apparatus involving a tennis backboard mounted on legs. A tennis backboard 10 of the invention mounted on the legs 31 of a stand 30 is shown in FIGS. 1 and 2. The backboard includes a firm backing layer 11 underlying a soft deadening layer 12.

The firm backing layer and soft deadening layer can be any suitable materials such that an appropriate rebound of a struck tennis ball is provided by the backboard. An appropriate rebound is a rebound that carries the tennis ball a distance at which a player can conveniently hit the ball repeatedly against the backboard. The ball rebounds a lesser distance than it would from a conventional rigid hard-surface backboard. Preferably the rebound carries the ball a distance such that the player can stand less than about 30 feet from the board to engage in a ground-stroke rally with the board (i.e., a rally wherein the player hits the ball on one bounce). Preferably, the rebound carries the ball a distance such that the player can stand about 12 to about 25 feet from the board to engage in a ground-stroke rally with the board. For a player to stand a given distance from the board in a ground-stroke rally, the ball would rebound to bounce on the ground about ⅔ to ¾ of the distance from the board that the player should stand.

The firm backing layer can be composed of any suitable material such that the firm backing layer provides adequate support to the soft deadening layer to give a consistent and appropriate rebound of the tennis ball from the backboard. For instance, it can comprise wood, fiberglass, plastic, or metal, or a combination thereof.

In a particular embodiment, the firm backing layer is an open mesh. By open mesh, it is meant that the firm backing layer has spaces that pass through it. For instance, it has been found that chicken wire is an adequate firm backing layer, particularly if supported by more rigid frame member behind it.

The firm backing layer can be a rigid or semi-rigid layer of, for instance, wood, metal, fiberglass, or plastic. By semi-rigid it is meant that the layer may flex. The firm backing layer can be much thinner and less rigid than a conventional tennis backboard. This is so particularly because the soft deadening layer absorbs much of the impact force of a tennis ball directed at the backboard and lessens the impact force on the firm backing layer.

The firm backing layer may also be or include a fabric mounted on a frame. The fabric should be held at least moderately taught on the frame. In one embodiment, the fabric consists of interlaced straps, such as that found in a folding outdoor lawn chair.

The firm backing layer is beneath the soft deadening layer. By this it is meant that the soft deadening layer forms the surface that is struck by the tennis ball or is closer to the surface that is struck by the tennis ball than the firm backing layer.

In a preferred embodiment, the soft deadening layer is a polymer foam, such as polyurethane foam. A particularly preferred embodiment is a 2-4 inch layer of open-cell standard firmness polyurethane foam.

A particularly preferred foam has a density of less than 2.5 $lbs/ft^3$. We have used an open-cell polyurethane foam with a density of approximately 1.8 $lbs/ft^3$. A preferred foam has a compression number of less than 45. The compression number is a standard measurement used in the foam industry that is also known as the inertial load deflection measurement. It is the amount of weight in pounds needed to compress a 4-inch thick piece of foam to 3 inches of thickness. In the test, the foam is a 15 inch by 15 inch square and the weight to compress it is a cylinder with a 15 inch radius. We have used a foam with a compression number of about 33.

An open-cell polyurethane with a density of less than 2.5 $lbs/ft^3$ and a compression number of less than 33 that is 2-4 inches thick (preferably 3-4 inches thick) allows the tennis ball to embed in the foam, and then be thrown back by the rebound of the foam. Thus, the ball does not come back due to the intrinsic rebound of the ball as it would on a solid wall, where the balls deforms and then reforms as it rebounds from the wall. Rather, it is the deformation and reformation of the foam that accounts for the rebound. This results in a rebound distance that is relatively similar regardless of how hard the ball is hit. It also results in a rebound direction that tends to be close to a perpendicular to the plane of the hitting surface of the backboard. That is, if a ball is hit at an angle from the right, it tends to come relatively straight out from the backboard, rather than rebounding at an equal angle toward the left. All three factors of thick foam, low weight density foam, and a low compression number foam contribute to these rebound characteristics.

Thus, in some embodiments, the soft deadening layer comprises a resilient polymer foam layer at least 2 inches thick, or at least 3 inches thick. In some embodiments, the soft deadening layer comprises resilient polymer foam with a compression number of less than 50, less than 45, less than 40, or less than 30. In some embodiments, the resilient polymer foam has a density of less than 3.0, less than 2.5, or less than 1.8 pounds per cubic foot. A low foam density also has the advantage of reducing the weight of the apparatus, making it more portable.

In some embodiments, the rebound of a tennis ball from the backboard is due to resilience of the foam and is not dependent on the intrinsic bounce of the ball. When this is the case, then the backboard or apparatus produces an equivalent rebound when struck with a tennis ball at 60 mph and when struck with a rigid ball of the same shape, size, and weight as a tennis ball at 60 mph, where the rigid ball does not bounce the same as the tennis ball against a rigid surface. As described above, the advantages of this are that the rebound distance is similar regardless of how hard a tennis ball is hit into the backboard, and the direction of the rebound also tends to be similar regardless of the angle of impact.

The soft deadening layer can be other types of polymer foam, such as neoprene or cross-linked polyethylene. These are typically closed cell foams. An open-cell foam is typically less dense and more easily deformed than a closed cell foam and performs better in the backboard. However, one disadvantage of open-cell foams is that they absorb water.

Closed-cell foams are advantageous for outdoor use in not absorbing water. One particularly preferred type of closed cell foam is a drain-through foam. These are closed-cell foams that are formed into an open lattice work through which water can drain. The lattice work compresses on impact, so that drain-through foams are more easily compressed than other closed-cell foams. They thus can have compression and rebound properties more similar to open-cell foam while also having the advantage of being waterproof.

The soft deadening layer in a particular embodiment comprises a waterproof material, e.g., a waterproof foam.

In a particular embodiment, the soft deadening layer is waterproof. In another embodiment, it does not absorb water (e.g., water may run through it without being absorbed). In other embodiments, the soft deadening layer does absorb water.

In a particular embodiment, the soft deadening layer comprises an air bladder. This can be similar to an air mattress. It can be composed of a flexible airtight material forming a bladder inflated with air. The bladder may be in some embodiments approximately 1-4 inches thick.

In a particular embodiment, the soft deadening layer comprises fibrous polymer fill. The polymer can be natural or synthetic, e.g., cotton or polyester. For instance, the fibrous polymer fill can be cotton or polyester quilt batting.

In particular embodiments, particularly where the soft deadening layer absorbs water, the backboard may include a fabric cover 13 (FIG. 3) mounted over the soft deadening layer. The tennis ball in this case would strike the fabric cover. The fabric cover may be waterproof, particularly if the soft deadening layer absorbs water.

Foam is typically sold in 2×6 foot pieces. Thus, to cover a backboard area of, e.g., 4×6 feet, at least two pieces of foam are needed. But if the soft deadening layer is composed of separate pieces of foam, without a fabric cover tennis balls that strike at the seam where two separate pieces of foam abut will tend to lodge between the two pieces or at least rebound irregularly. But if the backboard comprises a fabric cover, this problem is entirely avoided. A consistent rebound is obtained even if a ball strikes the fabric cover over a seam between separate pieces of foam.

Thus, in particular embodiments, the soft deadening layer includes two or more resilient foam pieces, the resilient foam pieces having lateral edges and abutting each other along their lateral edges. The lateral edges along which they abut may be oriented horizontally or vertically or another direction. In specific embodiments, especially where the soft deadening layer includes a plurality of pieces of foam, the backboard includes a fabric cover covering the soft deadening layer in use. Preferably, the fabric cover is detachable.

The fabric cover should have good flexibility and should generally fit rather loosely over the soft deadening layer. It has been found with polyurethane open cell foam as the soft deadening layer that if the fabric is stiff or fits too taughtly, the ball rebounds off the fabric without embedding in the foam. The ball in this situation tends to rebound at too high an angle and not far enough from the backboard.

Polyester fleece provides a good fabric cover that prevents balls from lodging in the seam between separate pieces of foam, and slightly adds to the deadening of the rebound.

A lightweight nylon ripstop (e.g., 1.9 oz. per sq. yard) also has adequate flexibility to be a good fabric cover. If it is polyurethane coated, it is also waterproof, which is important to keep a water-absorbent deadening layer dry.

In a preferred embodiment, the backboard includes a coated nylon ripstop cover immediately over an open-cell polyurethane foam deadening layer, and a fleece cover over the nylon ripstop. Both covers provide some additional deadening of the rebound. Thus, a player can adjust the liveliness of the bounce by choosing to use only one or both covers. If only one cover is used, it can be either the fleece cover or the ripstop nylon cover.

The apparatus may also include a further durable waterproof cover to cover the backboard when not in use, to keep the backboard, including other fabric covers used in the backboard, dry and protected from the sun. The durable outer waterproof cover may be vinyl coated nylon, for instance. This durable waterproof cover is generally removed for use, but may optionally be left on for use. If the vinyl cover is left on, the ball rebounds at a higher angle and bounces a shorter distance from the backboard. This may be suitable for some players who want to stand at a closer distance from the backboard.

The fabric covers may be sewn to form a cap on their upper edges that fits over the upper edge of the backboard. Thus, the fabric covers hang from the upper edge of the backboard.

In specific embodiments, the soft deadening layer of the backboard comprises resilient polymer foam that is detachable from the firm backing layer. It is preferable that the foam be detachable for convenient breakdown and storage of the apparatus. It is especially preferable that the foam be detachable if the foam is an open-cell foam that absorbs water, so that it can be removed to dry or clean in the event that it gets wet. Detachable foam may be held in place by a fabric cover, by velcro, by straps, by squeezing into a confined space between side or top and bottom supports surrounding the backboard firm backing layer, or by gravity as the foam pieces rest against a backward leaning firm backing layer and on top of a lower shelf at the bottom edge of the firm support layer. It can also be held in place by a combination of these factors.

In particular embodiments, the backboard is rectangular in shape and 3 to 8 feet tall and 4 to 12 feet wide. In particular embodiments, the backboard is rectangular in shape and 4 to 6 feet tall and 4 to 8 feet wide.

Preferably the backboard has a top edge, a bottom edge, a right edge, and a left edge (which may be curved or straight and may not be oriented perfectly vertically or horizontally), and the distance between the top and bottom edges is at least 3.5 feet at the tallest point, and the distance between the right and left edges is at least 3.5 feet at the widest point. These dimensions are generally necessary to provide a large enough target for players of average skill to consistently hit the backboard.

Preferably the apparatus is small enough and light enough to be movable. In particular embodiments, the apparatus weighs less than 100 pound, less than 70 pounds, or less than 50 pounds. These weights are light enough to allow most adults to move the apparatus without the help of a second person. In some embodiments, the apparatus includes detachable weights that mount on the apparatus to stabilize the apparatus against tipping over in the wind, e.g., on feet of a base or on a stand. The weight of these detachable weights is not included in the weight limits listed here.

Figure 3:
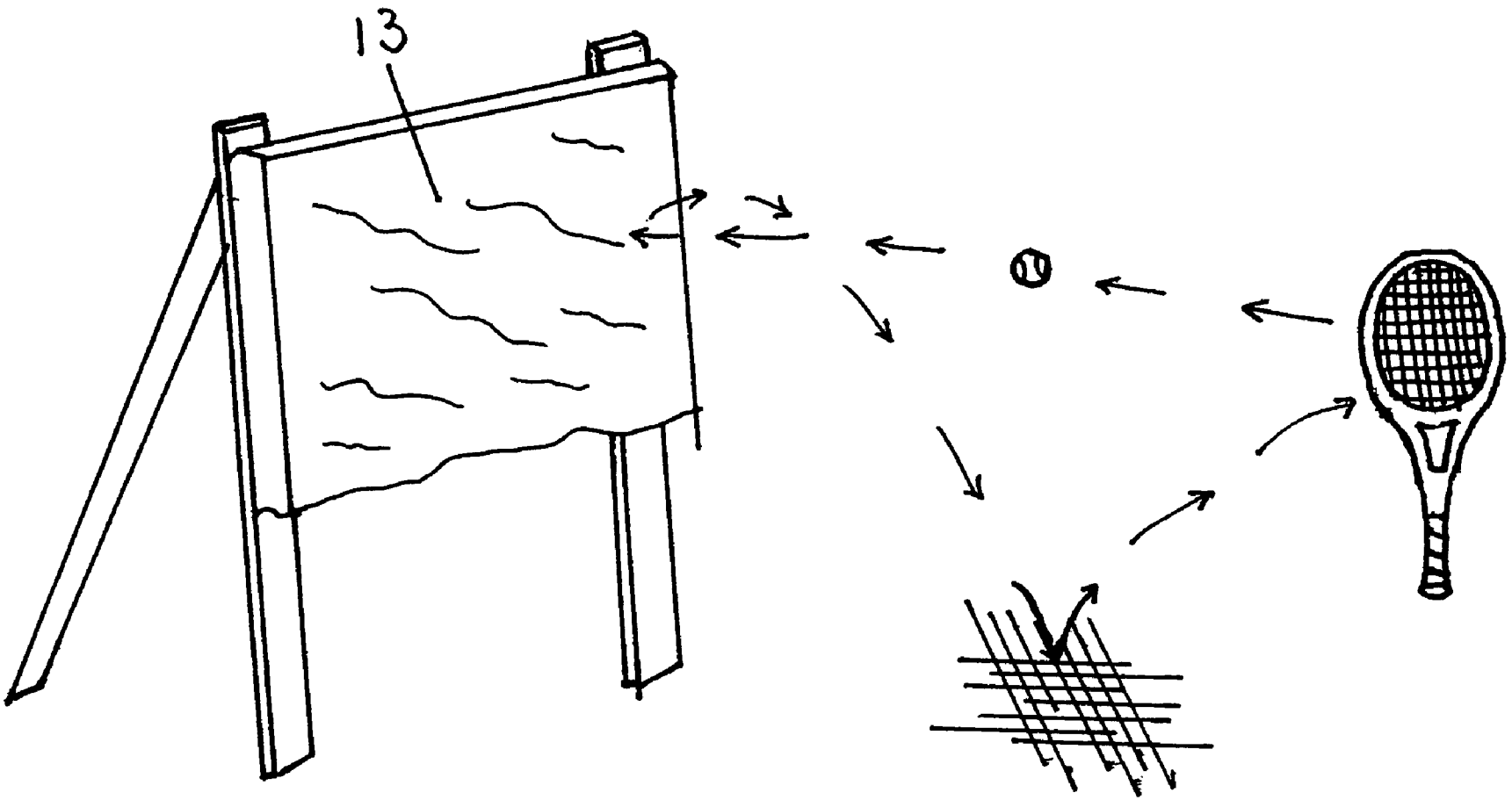
FIG. 3 shows an apparatus and backboard of the invention in use with the rebound trajectory of the tennis ball in use shown.
Figure 4A:
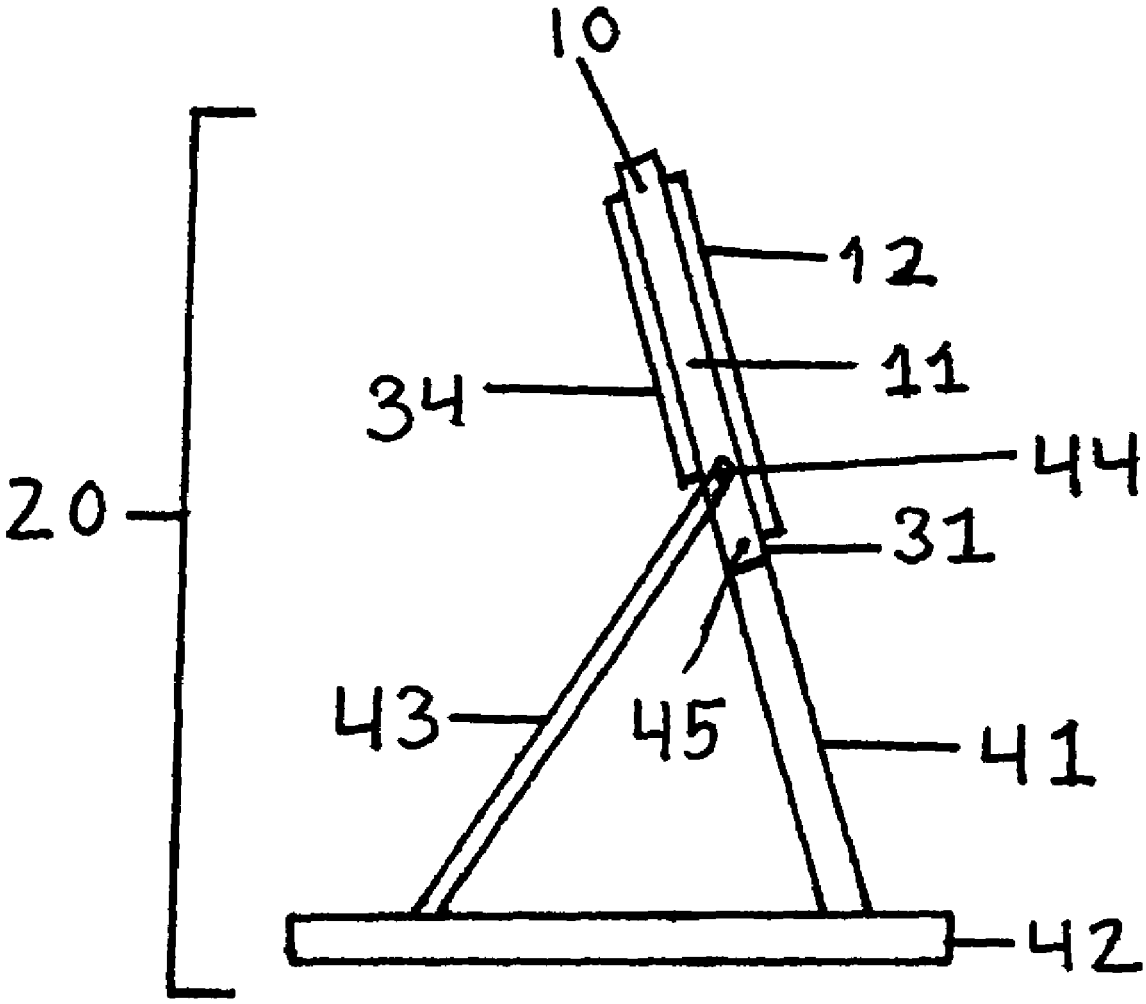
FIGS. 4A and 4B show a side view of an apparatus of the invention.
Figure 4B:
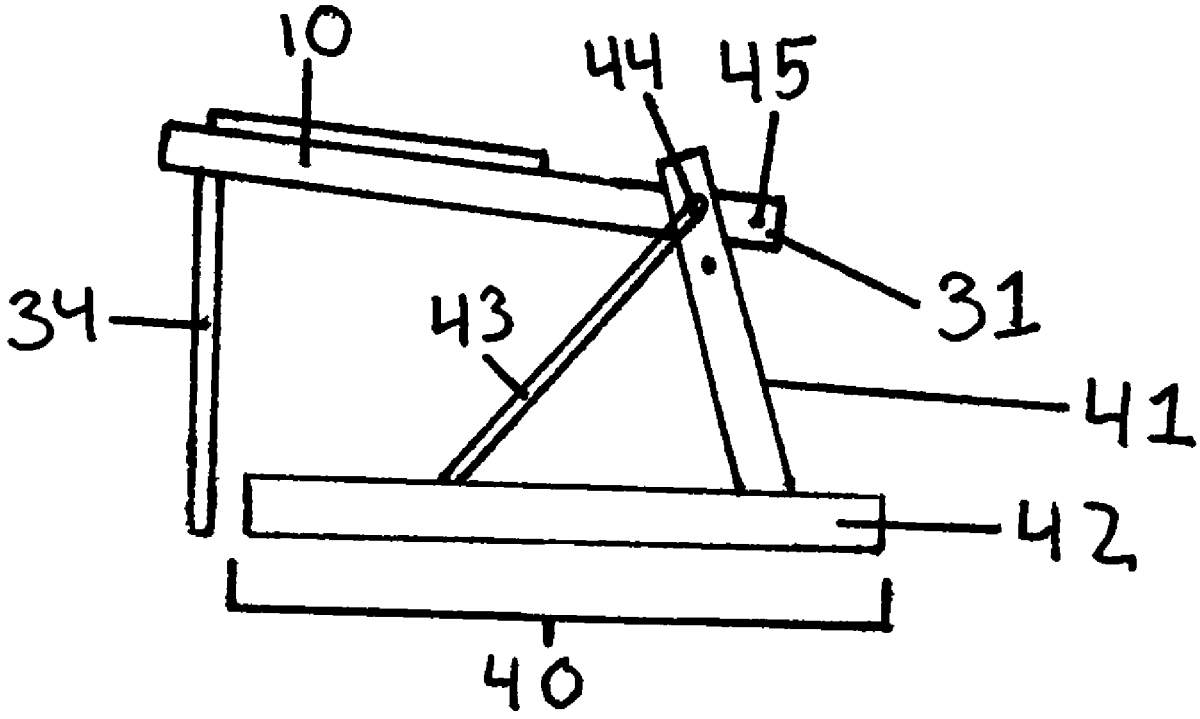
Figure 5A:
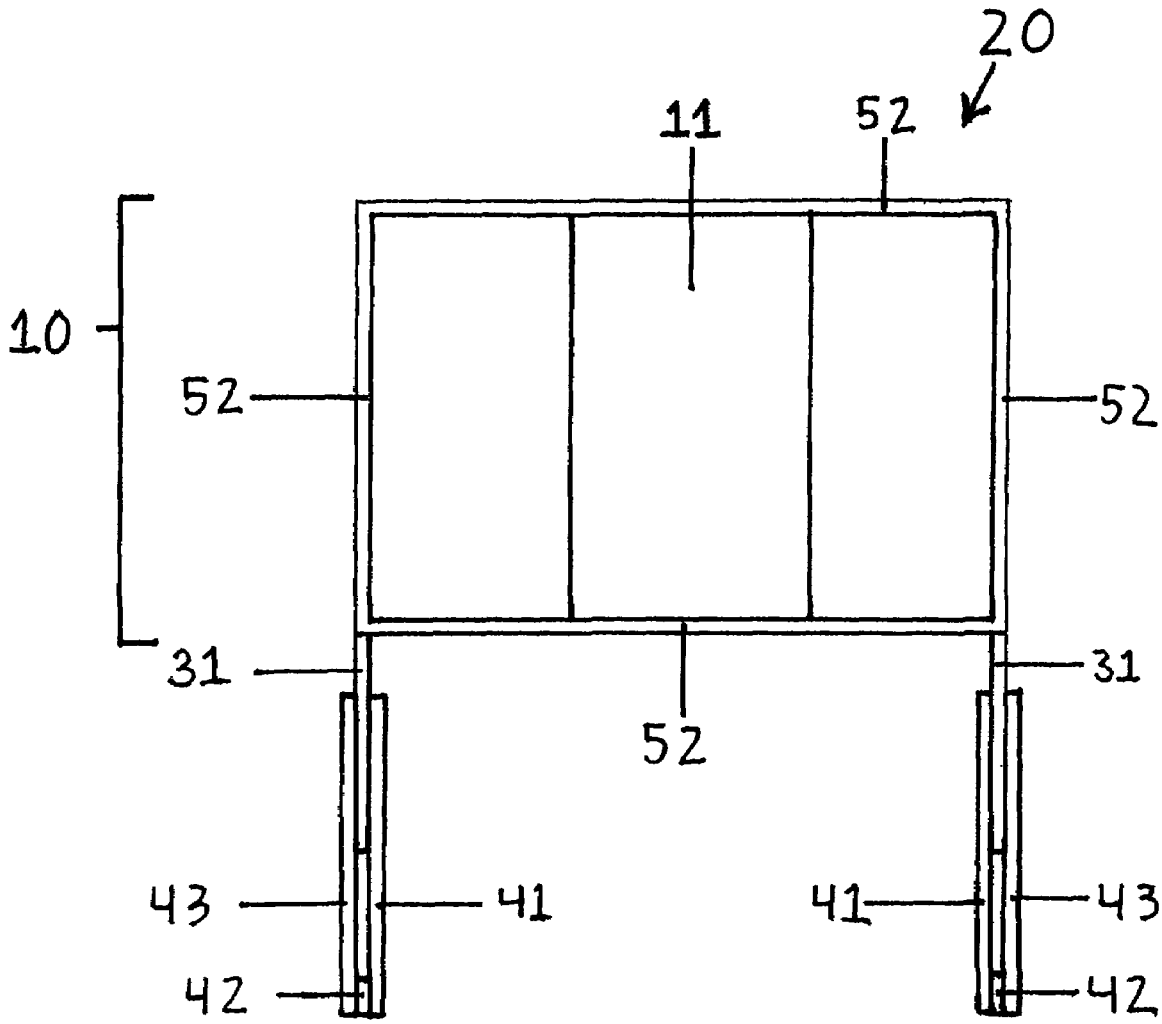
FIGS. 5A and 5B show a front and back view, respectively, of an apparatus of the invention.
Figure 5B:
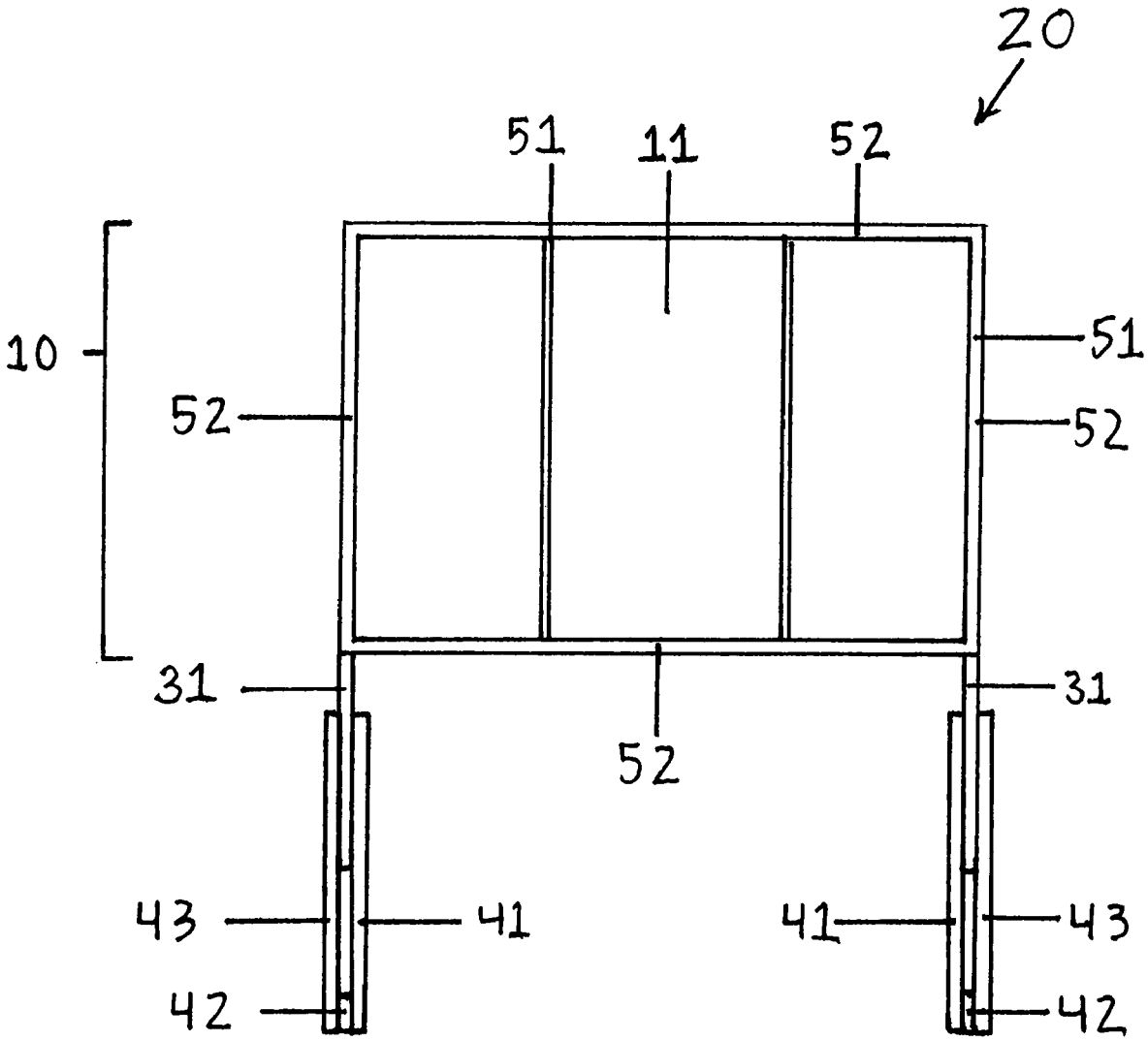

In use, the backboard may rest on the ground, or it may be supported off of the ground on a stand, such as stand 30 shown in FIGS. 1-3. If it is supported so that the bottom edge of the backboard is 3 to 3.5 feet off the ground, the bottom edge is at the regulation height of a tennis net, which is 3 feet high in the center of the court and 3.5 feet at the outer ends. This is a convenient height, and holding the backboard at this height helps train the player to hit the ball over the net. Mounting the backboard so it does not extend all the way to the ground also reduces the needed weight of the backboard.

Thus, one embodiment of the invention provides an apparatus comprising the tennis backboard of the invention mounted on two or more legs. The backboard may be mounted directly on the legs, or it may be mounted on the legs by resting on a stand 30 supported by the legs 31. It may be attached to the legs 31 or the stand 30, or it may rest by gravity on the stand on brackets 32 on the legs 31, as shown in FIGS. 1-3.

In particular embodiments, the backboard has a top and a bottom edge and a right and a left edge, and the backboard is mounted such that the bottom edge is about 2.5-4.0 feet above the ground, preferably 3.0-3.5 feet above the ground.

In particular embodiments, the backboard is permanently or semi-permanently mounted on the legs. Permanent or semi-permanent mounting could be, for instance, by means of rivets or nuts and bolts.

In other embodiments, the backboard is detachably mounted on the legs. For instance, it may simply rest by gravity on a stand supported by the legs. Preferably if it is resting by gravity on the stand, the stand holds the backboard at a backward angle as shown in FIGS. 1 and 2. The backboard may also be attached to the legs, or the stand supported by the legs, by means of quick-release clamps or bolts and wing nuts designed to be quickly detached by hand.

The stand holding the backboard may be free standing and movable, or it may lean against a permanent structure, such as a house or garage. The legs of the stand may also be permanently mounted in the ground, or attached to a structure mounted in the ground, such as fence posts for a public tennis court, if the apparatus is not portable.

The backboard may be mounted on the legs in a vertical position. It also may be mounted at a backward angle of 1 to 45 degrees relative to a perpendicular to the ground, more preferably 5 to 30 degrees, most preferably about 10 degrees relative to a perpendicular to the ground. With a backward angle, the backboard will rebound a struck tennis ball at a higher trajectory than a vertical backboard as shown in FIG. 3. This can be advantageous. From a vertical backboard, a ball tends to come back with a lower trajectory than does a ball in a rally between two players on a court. Mounting the backboard at a backward angle causes the ball to rebound at a higher trajectory and drop to the player from a greater height than the ball rebounds from a conventional backboard. This trajectory of the ball is somewhat more realistic in reproducing the experience of a rally in a tennis match. If a conventional rigid hard-surface backboard were mounted with a backward lean, the ball would tend to ricochet so high and far that it would be impossible to sustain a rally. But with the deadening layer of the present backboard, the rebound of the ball is reduced so that the backboard launches a rebounded ball at a comfortable and realistic arc that drops the ball a relatively short distance from the backboard. Thus, the player can easily sustain a long rally against the backboard even, or especially, when the backboard is mounted with a backward lean. A preferred backward lean is 5-30° from a perpendicular to the ground, more preferably about 10°.

Another advantage of mounting the backboard at a backward lean is that then gravity can be used to hold the soft deadening layer in place. For instance, open-cell polyurethane foam 2-4 inches thick can be used for the soft deadening layer. If the backboard leans backward, these can be held in place by resting by gravity on the firm backing layer and on a shelf that constitutes the lower edge of the backboard.

In particular embodiments, the backboard is mounted on the stand at a fixed angle. In other embodiments, the backboard is mounted at a variable angle. An apparatus with a means for varying the angle of the backboard allows the player to experiment with different angles to find an angle that rebounds the ball at a comfortable trajectory. It also can allow the backboard to rebound the ball in a very high arc that simulates a lob. This allows a player to practice an overhead shot against the "lob-like" rebound.

In a particular embodiment of the invention, the soft deadening layer is a layer of a resilient foam at least 2 inches thick.

In a particular embodiment of the backboard, the soft deadening layer is a closed cell foam.

In a particular embodiment of the backboard, particularly where the soft deadening layer is closed cell foam, the backboard does not have a waterproof cover or film covering the soft deadening layer.

Where the soft deadening layer is or comprises foam, and especially particularly open cell foam, the foam in general does not have an adherent waterproof film or adherent waterproof fabric bonded to the foam. An adherent waterproof film or adherent waterproof fabric tends to interfere with the rebound properties of the backboard and prevent balls from embedding in the foam and rebounding straight out from the foam. Instead, the balls fail to embed in the foam and tend to rebound at an upward angle that is often excessive.

In a particular embodiment, the soft deadening layer is detachable. That is, it can be removed by hand. It is not glued to the backing layer, or attached by permanent or semi-permanent fasteners.

The backboard can also be folded down into a generally horizontal position in the apparatuses of the invention, as is shown in Example 1 below. This facilitates manipulations of the apparatus such as removing or replacing covers or foam. It also lower the center of gravity and reduces the wind profile of the apparatus to stabilize the apparatus. Thus, in some embodiments of the apparatuses of the invention, the backboard folds down into a generally horizontal position (i.e., an angle within 45°, preferably within 30°, of horizontal).

Preferably, the apparatuses of the invention are free standing. The apparatus may alternatively be adapted to lean against a structure such as a house or garage.

In one embodiment of the apparatus involving a backboard mounted on a stand comprising a plurality of legs, the stand comprises a base on which the legs are mounted, wherein the base or the base and legs collectively contact the ground at at least three points covering a depth of at least 3 feet forward-to-back (in the direction perpendicular to the surface of the backboard), and the apparatus is free-standing. An example of this is shown in FIGS. 4A, 4B, 5A, and 5B. The backboard 10 is mounted on legs 31 and the legs are mounted on base 40, which includes two parallel feet 42. The feet contact the ground, at least at their ends, and are at least 3 feet long. The feet are preferably 4-6 feet long. The base 40 and legs 31 collectively constitute a "stand," as the term is used herein.

In particular embodiments, the backboard is detachable from the base. For instance, in FIGS. 4A and 4B, the apparatus includes two quick release connectors 44 and 45 linking each leg to the base. The connectors, which may be knob screws, can be removed by hand to detach the backboard from the base.

In particular embodiments, the apparatus includes a means for folding the backboard into a more horizontal position while maintaining coupling between the backboard and base. For instance, in FIGS. 4A and 4B, the lower quick release connector 45 on each leg can be removed, allowing the backboard to pivot about the upper connector 44 and swing down into a horizontal position. Alternatively, the apparatus may include a hinge mechanism in the leg or at the point where it joins the leg that allows the backboard to fold down to a more horizontal position.

Thus, in particular embodiments, the backboard is mounted on two legs, and each of the legs is mounted on a base by an upper pivot mount and a lower detachable mount, wherein when the lower detachable mount is removed the backboard can fold down into a more horizontal position.

Folding the backboard into a more horizontal position allows a user to more easily perform manipulations such as changing, adding, or removing the fabric covers or removing the soft deadening layer. It also lowers the center of gravity and reduces the wind profile of the apparatus, making it much more stable for storage when not in use.

In particular embodiments of the backboard apparatus with the base, the backboard is held at a backward lean of 5°-30° relative to a perpendicular to the ground when in use, preferably about 10°.

In particular embodiments of the apparatus, the base or stand of the apparatus includes at lest two wheels positioned in the base or stand to be able to contact the ground and bear the weight of the apparatus for portability. For instance, in the apparatus of FIGS. 4A, 4B, 5A, and 5B, two wheels could be mounted on the outer side of the left foot a short distance above the ground. By lifting the right foot of the apparatus, the apparatus tips to allow the wheels on the left foot to contact the ground and bear the weight of the apparatus, and the apparatus can be rolled on the wheels. Alternatively, retractable wheels can be used that can be pushed down to contact the ground to move the apparatus, and retracted up when the backboard is in use so it does not roll. Alternatively, the base or stand could include four mounted wheels that are the points of contact with the ground if the wheels have a locking mechanism. The wheels could be locked when the apparatus is in use and unlocked to move the apparatus.

In particular embodiments, the apparatus includes one or more stabilizing weights detachably coupled to the base or stand to stabilize the apparatus. For instance, in FIGS. 4A and 4B, four sandbags or saddlebags containing bricks or gravel can be placed over the ends of each of the two feet to stabilize the apparatus, particularly to stabilize it against overturning in high winds. The detachable weights are preferably light enough to be conveniently removed when a user wants to move the apparatus, e.g., less than 50 pounds or less than 25 pounds each.

In particular embodiments, the apparatus, excluding any detachable weights added to provide stability, weighs less than 120 pounds, less than 100 pounds, less than 70 pounds. or less than 50 pounds.

One embodiment of the invention is a tennis training apparatus comprising: a backboard comprising (i) a firm backing layer underneath (ii) a soft deadening layer comprising closed-cell foam; wherein the backboard is adapted to be mounted permanently on supports; and wherein the backboard is weatherproof and adapted to be stored permanently outdoors. The apparatus is stored permanently outdoors without a removable waterproof cover that is removed when the backboard is in use.

In specific embodiments, the backboard is mounted permanently to the ground. For instance, it may be mounted on fence posts that are fixed in the ground.

In one embodiment, the weatherproof backboard apparatus includes legs as supports on which the backboard is mounted, wherein the backboard has a top edge and a bottom edge, and the backboard is mounted such that the bottom edge is 2.5-4.0 feet above the ground.

In some tennis backboards, the backboard has an opening to serve as a target and capture balls hitting the opening in the backboard, or an opening through which balls are fired by a ball machine from the backboard. The present apparatus does not generally have these features. The apparatus generally does not have an opening in the fabric cover or soft deadening layer of the backboard or the firm backing layer to allow struck balls to pass through or be captured.

The invention will now be illustrated with the following example. The example is intended to illustrate the invention but not limit its scope.

EXAMPLE 1

A tennis training apparatus of the invention is shown in FIGS. 4A, 4B, 5A, and 5B. The apparatus 20 includes a backboard 10 having a firm backing layer 11 and a soft deadening layer 12. The firm backing layer is composed of MASONITE panels. The MASONITE panels are connected to oak supports 51 (visible from the back of the backboard in FIG. 5B) and an oak frame 52 of 1"×3" boards. The backboard in this example is 6 feet wide by 4 feet tall. The legs 31 are two pieces of the frame 52 and extend two feet below the backboard. The lower edge of the backboard frame 52 is a 1"×3" board that serves as a shelf to support foam sheets that are the soft deadening layer 12. The foam sheets rest against the lower shelf 52 and the firm backing layer 11 by gravity. They are also held in place by a cover 13 (shown in FIG. 3). The legs 31 are mounted on a base 40 by two quick-release attachments 44 and 45 on each leg. The attachments 44 and 45 in this example are knob screws that can be screwed in or removed by hand. The base 40 includes two parallel feet 42, two upright supports 41, and two cross braces 43. Each leg 31 is attached to the upright support 41 and the cross brace 43 through an upper knob screw 44, and attached to the upright support 41 through a lower knob screw 45.

The foot 42 may be 4-6 feet long. By extending in front and behind the backboard 10, it stabilizes the apparatus 20 against being blown over by the wind. It may be necessary to place detachable weights, e.g., saddle bags filled with bricks, gravel, or sand, over the front and back ends of the feet 42 to prevent the apparatus from being blown over in winds above about 25 mph. The detachable weights can be relatively light, e.g., 16 pounds each, so that they can be conveniently removed so that the apparatus is more portable.

The lower knob screw 45 can be removed so the backboard 10 swings down into a generally horizontal position. Folding legs 34 are mounted on the back of the backboard 10, and fold down to support the backboard 10 in a horizontal position. Folding the backboard down allows a user to conveniently remove or change fabric covers 13 on the backboard and foam pieces making up the soft deadening layer 12 of the backboard 10. Folding the backboard down to the horizontal position also facilitates moving the backboard through a garage door and into a garage. The apparatus may be stored outdoors with the backboard in the horizontal position as well because this position lowers the center of gravity and greatly reduces the wind profile of the apparatus, making it stable even in very high winds without the need for any detachable weights on the feet 42.

The backboard 10 can be completely removed from the base 40 by removing both of the knob screws 44 and 45 on each leg. This also is convenient for storage.

In this example the backward lean of the backboard is 10° from a perpendicular to the ground. The lower edge of the backboard is 39 inches above the ground, the average height between the high and low points of a tennis net.

All patents, patent documents, and other references cited are hereby incorporated by reference.

What is claimed is:

1. A tennis training apparatus comprising:

(a) a backboard comprising (i) a firm backing layer underneath (ii) a soft deadening layer; mounted on (b) a stand;

wherein rebound of a tennis ball from the backboard is reduced as compared to rebound from a rigid hard-surface backboard, and wherein the apparatus is portable;

wherein the soft deadening layer comprises resilient polymer foam that is at least 2 inches thick;

wherein the apparatus, excluding any detachable weights added to provide stability, weighs less than 100 pounds and can be moved by being carried by one adult of average strength without tools;

wherein deformation and reformation of the foam accounts for the rebound of a tennis ball, such that the apparatus produces an equivalent rebound when struck with a tennis ball at 60 mph and when struck with a rigid ball of the same shape, size, and weight as a tennis ball at 60 mph, where the rigid ball does not bounce the same as the tennis ball against a rigid surface;

further comprising at least one detachable fabric cover covering the soft deadening layer in use.

2. A tennis training apparatus comprising:

(a) a backboard comprising (i) a firm backing layer underneath (ii) a soft deadening layer; mounted on (b) a stand;

wherein rebound of a tennis ball from the backboard is reduced as compared to rebound from a rigid hard-surface backboard, and wherein the apparatus is portable;

wherein the soft deadening layer comprises resilient polymer foam that is at least 2 inches thick;

wherein the apparatus, excluding any detachable weights added to provide stability, weighs less than 100 pounds and can be moved by being carried by one adult of average strength without tools;

wherein deformation and reformation of the foam accounts for the rebound of a tennis ball, such that the apparatus produces an equivalent rebound when struck with a tennis ball at 60 mph and when struck with a rigid ball of the same shape, size, and weight as a tennis ball at 60 mph, where the rigid ball does not bounce the same as the tennis ball against a rigid surface;

wherein the soft deadening layer comprises 2 or more resilient foam pieces, the resilient foam pieces having lateral edges and abutting each other along their lateral edges, and the apparatus further comprises at least one detachable fabric cover covering the resilient foam pieces in use.

3. A tennis training apparatus comprising:

(a) a backboard comprising (i) a firm backing layer underneath (ii) a soft deadening layer; mounted on (b) a stand;

wherein rebound of a tennis ball from the backboard is reduced as compared to rebound from a rigid hard-surface backboard, and wherein the apparatus is portable;

wherein the soft deadening layer comprises resilient polymer foam that is at least 2 inches thick;

wherein the apparatus, excluding any detachable weights added to provide stability, weighs less than 100 pounds and can be moved by being carried by one adult of average strength without tools;

wherein deformation and reformation of the foam accounts for the rebound of a tennis ball, such that the apparatus produces an equivalent rebound when struck with a tennis ball at 60 mph and when struck with a rigid ball of the same shape, size, and weight as a tennis ball at 60 mph, where the rigid ball does not bounce the same as the tennis ball against a rigid surface;

wherein the soft deadening layer comprises 2 or more resilient foam pieces, the resilient foam pieces having lateral edges and abutting each other along their lateral edges, and the apparatus further comprises a first detachable fabric cover covering the resilient foam pieces in use that is not waterproof, and further comprising a second waterproof detachable rain cover covering the first fabric cover and adapted to be optionally removed when the backboard is in use.

4. A tennis training apparatus comprising:

(a) a backboard comprising (i) a firm backing layer underneath (ii) a soft deadening layer; mounted on (b) a stand;

wherein rebound of a tennis ball from the backboard is reduced as compared to rebound from a rigid hard-surface backboard, and wherein the apparatus is portable;

wherein the apparatus, excluding any detachable weights added to provide stability, weighs less than 100 pounds and can be moved by being carried by one adult of average strength without tools; and wherein the soft deadening layer comprises resilient polymer foam that is at least 2 inches thick and is detachable from the firm backing layer;

further comprising at least one detachable fabric cover covering the soft deadening layer in use.

5. A tennis training apparatus comprising:

(a) a backboard comprising (i) a firm backing layer underneath (ii) a soft deadening layer; mounted on (b) a stand;

wherein rebound of a tennis ball from the backboard is reduced as compared to rebound from a rigid hard-surface backboard, and wherein the apparatus is portable;

wherein the apparatus, excluding any detachable weights added to provide stability, weighs less than 100 pounds and can be moved by being carried by one adult of average strength without tools; and wherein the soft deadening layer comprises resilient polymer foam that is at least 2 inches thick and is detachable from the firm backing layer;

wherein the foam is two or more resilient foam pieces having lateral edges and abutting each other along their lateral edges, the apparatus further comprising a first detachable fabric cover covering the resilient foam pieces in use that is not waterproof, and further comprising a second waterproof detachable rain cover covering the first fabric cover.

6. A tennis training apparatus comprising:

(a) a backboard comprising (i) a firm backing layer underneath (ii) a soft deadening layer of resilient polymer foam at least 2 inches thick and having a density of less than 2.5 $lbs/ft^3$ and a compression number of less than 45; mounted on (b) a stand;

wherein the backboard is generally planar and is held on the stand at a backward lean of 5°-30° relative to a perpendicular to the ground, rebound of a tennis ball from the backboard is reduced as compared to rebound from a rigid hard-surface backboard, and the apparatus is portable;

wherein the apparatus, excluding any detachable weights added to provide stability, weighs less than 100 pounds and can be moved by being carried by one adult of average strength without tools;

wherein the stand comprises a plurality of legs, the backboard has a top and a bottom edge and a right and a left edge, and the backboard is mounted on the stand such that the bottom edge of the backboard is 2.5-4.0 feet above the ground;

wherein deformation and reformation of the foam accounts for the rebound of a tennis ball, such that the apparatus produces an equivalent rebound when struck with a tennis ball at 60 mph and when struck with a rigid ball of the same shape, size, and weight as a tennis ball at 60 mph, where the rigid ball does not bounce the same as the tennis ball against a rigid surface;

wherein the soft deadening layer comprises 2 or more resilient foam pieces that are detachable from the firm backing layer, the resilient foam pieces having lateral edges and abutting each other along their lateral edges, and the apparatus further comprises a first detachable fabric cover covering the resilient foam pieces in use that is not waterproof, and further comprising a second waterproof detachable rain cover covering the first fabric cover and adapted to be optionally removed when the backboard is in use.

7. The apparatus of claim 6 wherein the apparatus further comprises one or more stabilizing weights detachably coupled to the stand to stabilize the apparatus.

* * * * *